United States Patent [19]

Kopelman

[11] Patent Number: 4,924,612

[45] Date of Patent: May 15, 1990

[54] FIBER OPTIC SIGN

[76] Inventor: Robert Z. Kopelman, 121 Fountain Ave., Rockville Centre, N.Y. 11570

[21] Appl. No.: 37,964

[22] Filed: Apr. 14, 1987

[51] Int. Cl.[5] ..... G09F 13/00

[52] U.S. Cl. ..... 40/547; 362/32

[58] Field of Search ..... 40/547, 543; 362/32; 350/96.34

[56] References Cited

U.S. PATENT DOCUMENTS

| | | | |
|---|---|---|---|
| 1,871,650 | 8/1932 | Bartley | 40/576 |
| 2,374,323 | 4/1945 | Bihr | 40/543 |
| 3,163,949 | 1/1965 | Gley | 362/32 |
| 3,516,724 | 6/1970 | Ashton et al. | 350/96.34 |
| 3,712,724 | 1/1973 | Courtney-Pratt | 362/32 |
| 3,978,599 | 9/1976 | Berger | 40/542 |
| 4,141,058 | 2/1979 | Mizohata et al. | 362/328 |
| 4,184,153 | 1/1980 | Glaubitz | 350/96.34 |
| 4,296,562 | 10/1981 | Sanborn | 40/547 |
| 4,394,714 | 7/1983 | Rote | 362/32 |
| 4,625,266 | 11/1986 | Winter | 362/32 |

*Primary Examiner*—Gene Mancene
*Assistant Examiner*—Cary E. Stone
*Attorney, Agent, or Firm*—William T. Hough

[57] ABSTRACT

A sign having letters preferably of fluorescent paint, on a substrate to which light is channelled by fiber optic plastic and/or fiber optic cable, from a low voltage and low amperage circuit and bulb connected in series with a doorbell apparatus and circuit thereof for illuminating the letters when the door bell is not activated to ring.

24 Claims, 4 Drawing Sheets

Fig. 5
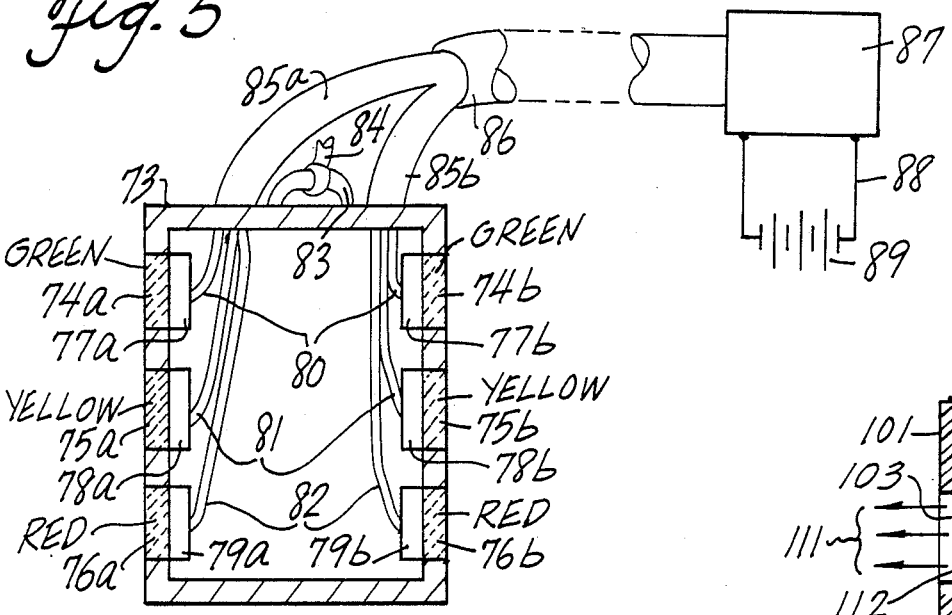
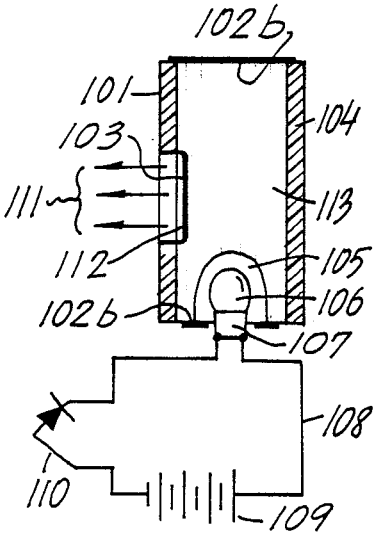
Fig. 7
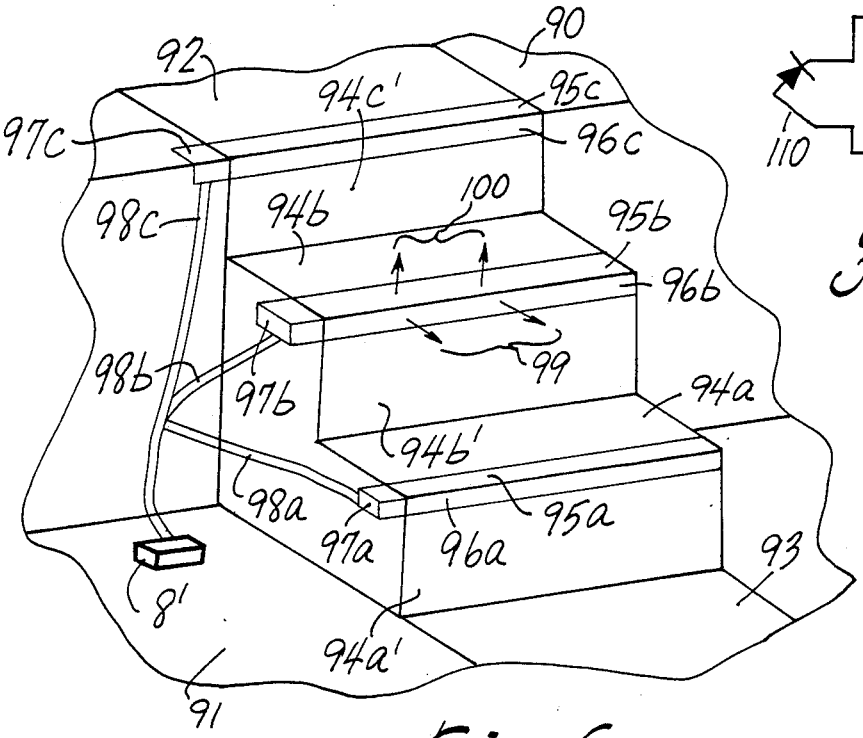
Fig. 6

FIBER OPTIC SIGN

This invention is directed to a novel sign embodying fiber optic structures.

BACKGROUND

Prior to the present invention, signs employing illumination from low intensity light derived from a circuit of low voltage and amperage, resulted in sign of such low illumination that the reading thereof was difficult if not impossible to read in the absence of putting one's eyes close to the letters to be read.

Additionally, where a plurality of letters and/or words and/or numbers are distributed over a sign of considerable width and/or height, in absence of a plurality of numerous lights and circuitry therefor, adequate and evenly-distributed illumination have proven difficult to achieve.

Also, where signs are not near electrical outlets, extensive wiring and use of union electricians and the like, add complications to efforts to set-up even the simplist of road and/or warning or other similar-type signs.

In theaters, inadequate lighting and/or repeated maintenance to replace burned-out bulbs or wet or old wiring, together with the installation thereof and the difficulty of getting to and maintaining the same, apart from the expense thereof, are some of the problems with those types of signs. Also, moisture collected or liquified from spilt drinks and/or wet-mopping, or the like, add to the likelihood of short circuits and potential fire hazards.

At traffic cross-walks, and/or highway mid-lines, difficulty in seeing the lines—particularly when wet as a result of rain, increases hazards to both pedestrians and motorists.

Often times, there is no electrification available in the vicinity where either temporary or permanent lighted signs might be desired for one reason or another, resulting in either inadequate use of temporary battery power or alternately no lighted sign at all—particularly where needed over extended period(s) of time.

Traffic lights normally require special expensive trucks and specialized workers to maintenance the same, requiring a plurality of different lights, results in repeated replacement of the plurality of bulbs in the inconveniently located traffic light.

OBJECTS OF THE INVENTION

Broadly, objects of the present invention include the overcoming and/or avoiding of difficulties and problems such as those noted-above.

More particularly, a particular object is to obtain a doorbell with an associated sign having a high illumination derived from a low voltage, low amperage low illumination light bulb, facilitating easy and correct reading of the sign associated therewith.

Another more particular object is to obtain a sign that can be illuminated adequately for easy reading in the absence of readily available electrification or plugs or batteries or the like.

Another object is to obtain novel signs avoiding problems of prior maintenance and difficulties thereof, together with improving illumination and safety advantages associated therewith in assisting the public relying thereon.

Another object is to obtain a novel sign utilizing existing distant light sources while concurrently achieving a high and adequate level of illumination for easy discernment and reading of a sign, configurations and/or letters and/or words and/or numbers thereon, particular of the warning-type sign notifying the public of the existence of potential or existing hazards.

Other objects become apparent from the preceding and following disclosure.

One or more of the objects are obtained by the invention as described herein and as illustrated in the accompanying drawings.

SUMMARY OF THE INVENTION

Broadly the invention may be described as a sign that includes a visibly-exposed substrate that can be lighted-up or illuminated by the directing of light onto it, i.e. it does not absorb a dominant proportion of the light nor block the light from discernible view. As noted-above, within the meaning intended in this invention, the word "absorb" is equivalent to the word "block", relative to light, as above-noted the blocking of light being the equivalent of absorbing light for purposes of the present invention. Additionally there is included as a composite part of the sign, one or more configuration-defining structures that either absorb substantially all illuminating light shone thereon or blocks such light from discernible view. Further, as a part of the sign combination, there is a fiber optic structure which includes fiber optic light-channeling channels and a light outlet end and side walls thereto, and positioned such that crystalline light channeled therethrough and emitted from a light-outlet end or through visibly-exposed substrate of the side walls thereof from which the substantially-opaque surface has been cut or abraided; thus, light being transmitted within that crystalline is directed upon the visibly-exposed substrate sufficiently to illuminate the visually-exposed substrate to a degree to be visibly discernible. The non-abraided or non-cut side wall of the fiber optic structure may thereby constitute the configuration-defining structure. As exhibited in following Figures, the portion from which light is not blocked by the opaque matter alternately (optionally) may circumscribe the area in which the opaque matter blocks the light, or the opaque matter may circumscribe the light-transmitting portion (i.e. the portion not blocked by opaque matter). Another essential component of the sign visibly discernible. And another essential component of the sign combination is one or more light-source structures for providing light and positioned such that the light is channeled into a light-inlet end of the fiber optic light-channeling channels. The light source-structure which normally would be a light bulb of some sort, such as either a high or low intensity regular spherical-type bulb or a fluorescent or mercure light, or arc-light, or any other equivalent light source, or either a generator AC or DC type or battery powered type. The light source also may be a phosphorescent or luminescent and/or other self-illuminating light source, having the advantage of requiring no outside power source. It must be understood, however, that the light-source structure may be any conventional or otherwise desired source or irradiation of visible-spectrum light and/or irradiation of a type not visible to the necked eye, and/or as might be necessary in part or in whole, to activate fluorescent matter to cause it to fluoresce. Additionally, the generic language "light-source structure(s)" includes mirror(s) and/or crystalline and/or other light-focasing and/or light-collecting structure(s) for collecting and/or concentrating light and feeding or directing it into one or more input-locations of the fiber optic structure(s). In particular, the illumination(s) resulting from automobile light(s) traveling a highway and the light (illumination) from the auto lights striking the collecting structure(s) becomes concentrated and redirected into the fiber optic structure of the present inventive structure. Likewise, the light-illumination from a street or other highway light(s) may be collected and rechannelled into the fiber optic structures of the present inventive combination-sign.

A major advantage of the present invention arises from its capability to obtain a reasonably brilliantly lighted sign sufficiently bright as to enable a person to easily see and/or discern and/or read the words, letters, numbers and/or other configuration easily in darkened areas.

The configuration-defining structure(s) typically is-/are structures that form a through-passage through which the substrate (when illuminated) may be discernibly seen, the configuration-defining structure(s) otherwise normally blocking-out most or all of the light of illumination deriving from the illuminated substrate or from the light source or from the fiber optic structure(s). Preferably, the configuration-defining structure forms (outlines) the shape of one or more of letter(s), number(s), numeral(s), the shape of animate and/or inanimate object(s), and/or the like.

In a preferred embodiment, the substrate is at-least partially transparent, i.e. either transparent and/or translucent in nature, and may be clear or colored in whole or in part, preferably colored, such that light emitted from the surface of the substrate when light from the light-source structures passes through the substrate is of the same color as the substrate or coloring thereof.

In a preferred embodiment, fluorescent matter of any conventional and/or commercially-available and/or desirable type or nature may be either or both incorporated into and/or coated on the substrate at position(s) and/or locations such that the fluorescent matter becomes activated and luminesces by virtue of light-illumination and/or irradiation received as channelled through the fiber optic structure. As a result, the brilliance of the lighted areas of the substrate are further enhanced to make visible discerment thereof even greater and/or easier to the eye of a person viewing the same.

In an alternate embodiment, the fluorescent matter is embodied in or coated on, i.e. in contact with, the configuration-defining structure and positioned to fluorescently accentuate typically circumscribing portions of the configuration-defining structure that circumscribe the substrate or portions thereof. Either alternately or in addition, the fluorescent matter is positioned such that light from the light-source structure(s) cause illumination which further casts fluorescent light onto the substrate.

It should be noted that the fiber optic structure may be one or more such structures. For example, there is conventional and commerically available fiber optic cables which are suitable for transmitting light over great distances, the light entering at one end thereof and being emitted at the other end thereof. Such cables may be spliced (joined) by known methods, and a major advantage of such cables is that the light follows the cables even though the cable may be bent or curved or make turns along the way. Another type conventional and commercially available fiber optic structure is a fiber optic plastic, the one position thereof being at the light-input ends of the crystalline light-conveying channels thereof, and the opposite distal other end (or side) thereof being the other end of the crystalline light-conveying channels serving as the light-output ends of the channels.

In one embodiment of the invention, the present inventor has novely discovered that by abraiding-away or cutting-away a surface of the portion of the fiber-optic structure corresponding to the side(s) of the surface-located crystalline light-conveying channels (embodied within and as a part of the plastic), or alternately the surface corresponding to the light-exiting ends of the light-conveying channels, light escapes through the abraided and/or cut portions of the plastic in a difussed manner. Moreover it has been discovered that greater difussion, i.e. spreading over a larger area of illumination, is obtained at the portion of the plastic representing the light-emitting ends of the crystalline channels, such a single light bulb placed at a limited single point (location) at the input end of the crystalline channels produces a light difused and spread brightly over the entire or at-least greatly-enlarged surface at the outlet ends of the fiber optic channels. In either arrangement, a typical approach at the light-input position is to cut-out a small portions (making a small hole slightly into the body of the plastic) and placing the bulb or light-source into the hole thereby produced, such that the light illuminates all surrounding plastic. A particular advantage of this broadened area being brightly lightened (illuminated) at the output end of the fiber optic structure(s), is that a single light bulb (or other light source) is enabled to illuminate substantially homogeneously letters, writing and/or other configurations of the sign covering a broad or large or lengthened (elongated) area, in contrast to concentrated light at a small location by signs heretofore in the absence of multiple lights positioned over a large input-area. Also for all outer exposed surfaces other than inlet and outlet areas of the fiber optic cable and/or plastic, and for areas where light could otherwise escape, reflective surfaces are employed to conserve and prevent loss of any light that thereby can be redirected beneficially.

In one embodiment of the invention, the light may be transmitted from the light-source structure(s) to the substrate and/or configuration-forming structure(s) by way of fiber optic cable(s). In another embodiment, the light may be transmitted from the light-source structure(s) to the substrate and/or configuration-forming structure(s) by way of fiber optic plastic that is typically transparent or translucent. In still another embodiment, light from light-source structure(s) may be transmitted by and through the fiber optic cable(s) to and illuminate transparent or translucent fiber optic plastic that constitutes the substrate and/or that constitutes the configuration-defining structure(s), and/or the outer surface of the substrate and/or configuration-defining structure(s).

In any one or more embodiment of the invention as typically described-above, there may additionally be incorporated any one or more of the fluorescent and/or luminescent matter as a coating at light-emitting light-exit portions of the fiber optic plastic, and/or embodied or impregnated within the body of the fiber optic plastic. In an embodiment in which the letter(s), number(s), word(s) and/or configuration(s) is/are formed by opaque matter, the fluorescent and/or luminescent matter may be embedied within the fiber optic plastic and-/or surrounding the opaque portion, in portions through which the light passed through or from the fiber optic plastic, and/or as a surface coating surrounding the opaque matter. In another embodiment, where opaque matter circumscribes and thereby forms the letter(s), number(s), word(s) and/or configuration(s), the fluorescent and/or luminescent matter may be on the light-receiving side of the opaque matter which is space-from the defined letter(s), number(s), word(s) and/or configuration(s)—in a position and manner such that as visually discerned from a position in front of the overall sign, the fluorescent and/or luminescent matter serve to further illuminate the defined letter(s), numeral(s), word(s) and/or configuration(s). Alternatively, where an opaque substrate circumscribes and thereby defines the letter(s), number(s), word(s) and/or other configurations or designs or shapes, the fluorescent material again may be embodied within or embedied within or coated on a light-outlet surface of the fiberoptic plastic.

In the novel sign may be in the nature of a small sign mounted on any one or more of a bicycle, motocycle, motor scooter, automobile, truck or the like, particularly of the warning variety, such as typically a disc, or a city or state maintenance vehicle having such sign mounted on the top thereof, or emergency vehicle(s) carrying such signs, such as on ambulances, police care (particularly of the unmarked police cars), firemens automobiles, and the like. Also, such signs are valuable as emergency signs carried in automobile trucks, to be set-out when repairing a tire, or when a car has motor trouble, or at the scene of an accident, or the like.

The invention may be better understood by making reference to the drawings of the following Figures.

FIGURES

FIG. 1A diagrammatically illustrates symbolic generic elements or combinations thereof, constituting the present inventive combination, shown in a flow-diagram fashion illustrating the flow of light during its operative function.

FIG. 1B diagrammatically illustrates symbolic elements arranged in a flow-diagram fashion illustrating the flow of light during its operative function, shown in part in cross-sectional views, for a sign functioning in accord with the combination of the present invention.

FIG. 1C diagrammatically illustrates an alternate embodiment of the invention of FIG. 1, likewise arranged in a flow-diagram fashion illustrating the flow of light during its operative function, shown in part in cross-sectional views, for a sign functioning in accord with the combination of the present invention.

FIG. 2A diagrammatically illustrates a typical and preferred doorbell-sign combination-embodiment of the present invention, described broadly above, shown in-part in side-cross-sectional view with light-bulb and electrical circuitry and the door bell, etc., together with illustrating particular elements of the sign itself, all symbolically shown.

Figure 4:
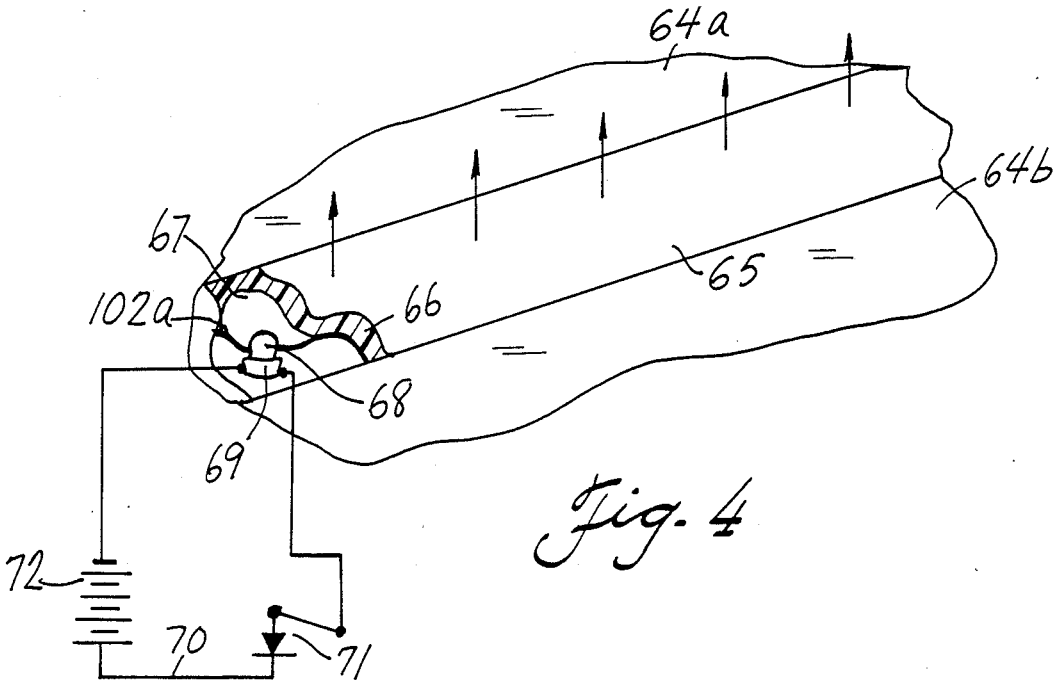

FIG. 4 diagrammatically illustrates another embodiment of the present invention, in which the sign combination is embodied in a floor slot-cut-out, the face of the sign extending flushly with the floor-surface, as a lighting guide to guide and/or light the path of walking or riding, etc..

FIG. 5 illustrate diagrammatically symbolic red-yellow-green traffic light elements in combination as a sign of the present invention, together with its circuitry, switching mechanism, and the like, in side view with partial cut-away.

FIG. 6 illustrates diagrammatically symbolic upper and lower floor landings with steps, embodying the sign-combination signs of the present invention, shown in side perspective view.

FIG. 7 diagrammatically illustrates another embodiment of the present invention, shown in side cross-sectional view, and including combination elements such as circuitry, light bulb, etc.

DETAILED DESCRIPTION

In the practice of the present invention, fiber optic cables and fiber optic plastic, and other plastics of the type typically utilized in the present invention are well known and conventional and commercially available. The April 1986 issue of "Popular Science" magazine at pages 100 and 101 thereof include a typical artical discuss such plastics and their compositions, including the plastic composition as well as die-material embodied therein of typically a light-guiding and die and/or fluescent matter-impregnated plastics, such as LISA (trademark of Mobay Corporation) plastics, mentioned in that article. Such LISA polymer-plastics are available atleast from Mobay Corporation, in a variety of forms, such as polycarbonate, and/or acrylic, formed by injection molding from pellets thereof or by extrusion, available in various colors of blue green, yellow, red/yellow, red/orange and dark red, for example. Such LISA plastics can be formed in conventional plastics processing machines and by conventional methods, according to Mobay Corporation.

To more fully understand the invention as typified by the illustrative embodiments of the Figures, but not limited to such merely exemplary embodiments, the preceding Figures are now described below in more complete detail.

Figure 1A:
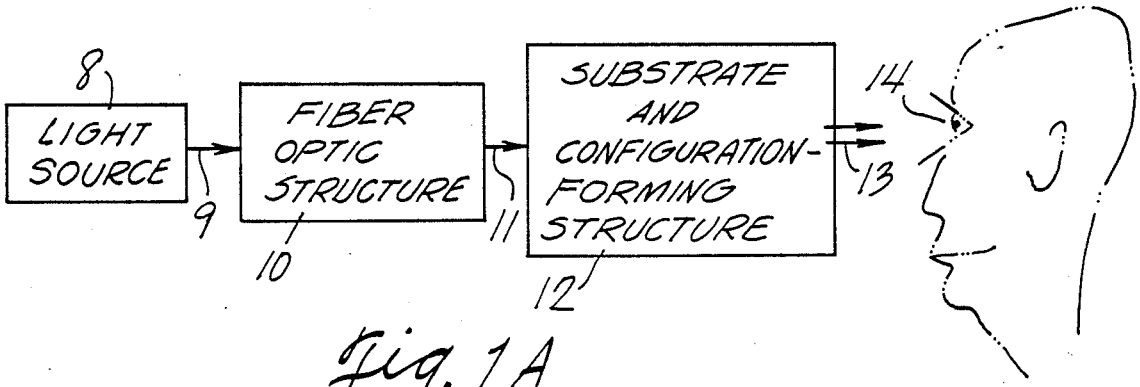

FIG. 1A may be said to be strickly diagrammatic and symbolic, but broadly generic in concept to the entire invention. More particularly, a light-source structure, arrangement and mechanism thereof cummulatively designated light-source 8, directs light 9 into a light-inlet portion of a fiber optic structure 10 such that light 11 is emitted from a light-outlet portion thereof directed onto one or more of a substrate and configuration-forming structure or combination, and arrangement thereof cummulatively designated substrate and configuration-forming structure 12, which when the light 13 thereof and/or appearance thereof as lighted is viewed discerib-ly by the eye 14, the letter(s), number(s) (numeral(s)), word(s) and/or other configuration of the sign are both discernible and recognizable to the person's eye 14.

Figure 1B:
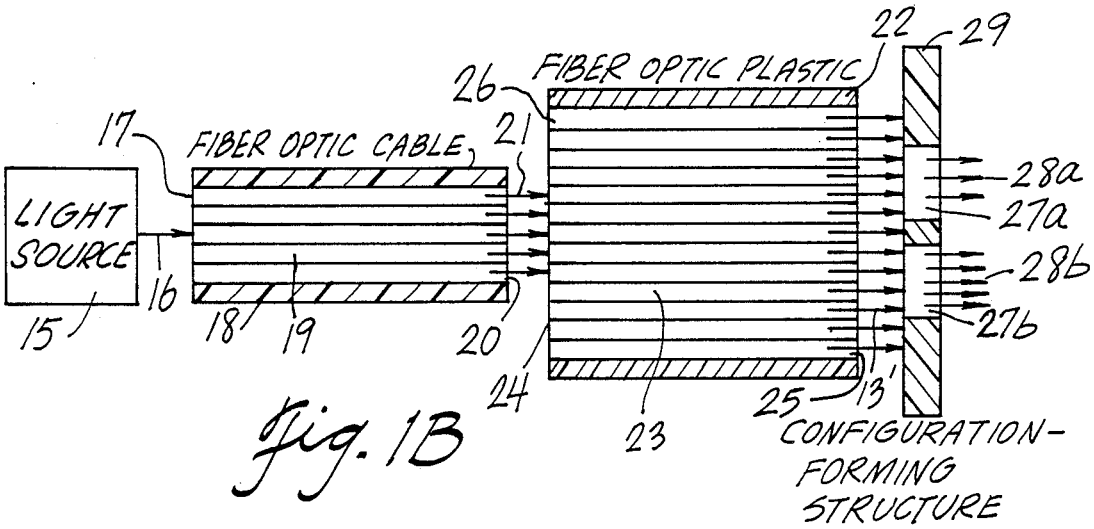

FIG. 1B illustrates still broadly, a particular embodiment again diagrammatically and merely symbolically presented, depicting a light source 15 emitting light 16 directed into an inlet end 17 of crystalline light-conveying channels 19 of fiber optic cable 18, illustrating light 21 being emitted over a much broader emission area and directed into a limited area of the light-inlet end 24 of crystalline light-conveying channels 26 of fiber optic plastic 22, emitting light 13' of substantially even intensity over a much larger area of the light-outlet portion 25 of the fiber optic plastic 22, such that light emitted or otherwise discernible as associated with the sign as viewed as it strikes the configuration-forming structure 29 and/or passes through the typical through-opening(s) 27a and 27b as light 28a and 28b, makes the defined letter(s), number(s), numeral(s), word(s) and/or other configuration(s) discernible and readable to the viewer of the sign during early morning, late evening and/or night when the light-source is activated to produce light. The fiber optic cable 18 has the fiber optic cable channel light-outlet portion 20. The fiber optic plastic 22 has light-conveying channels 23.

Figure 1C:
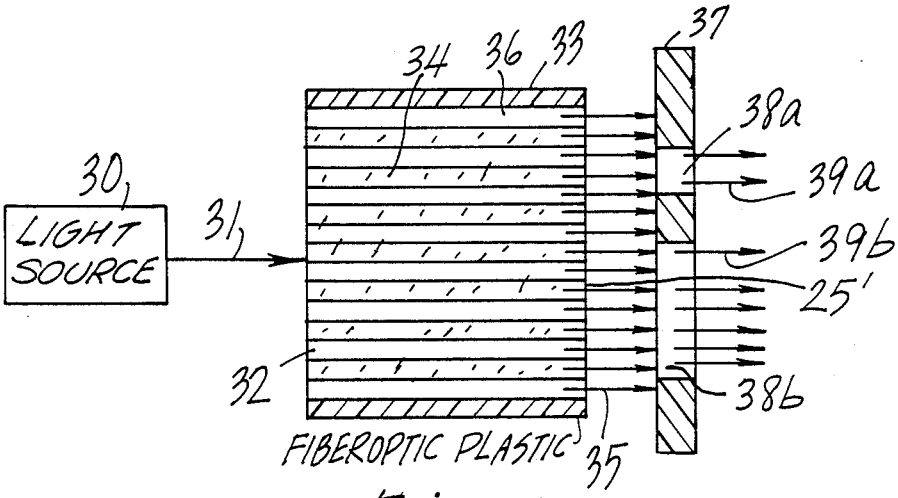

FIG. 1C illustrates an alternate embodiment omitting the fiber optic cable, otherwise basically the same as that of FIG. 1B, the FIG. 1C embodiment showing a light source 30 emitting light 31 over a narrow cross-sectional area, directed into the light-inlet end 32 of the fiber optic crystals 36 of the fiber optic plastic 33 embodying fluorescent and/or luminescent substance(s) or material(s) 34, to emit light 35 of substantially even (equal) illumination over a much broader (increased) area of emission at the light-outlet end 25' of the fiber optic plastic 33. The light 35 strikes the substrate 37 or passes through through-opening(s) 38a and 38b thereof as light 39a and 39b. By virtue of portions of light 35 being blocked-out (blocked-out by the substrate 37), the light 39a and 39b is visibly discernible as defined letter(s), number(s), word(s) and/or other configurations of the overall sign.

Figure 2A:
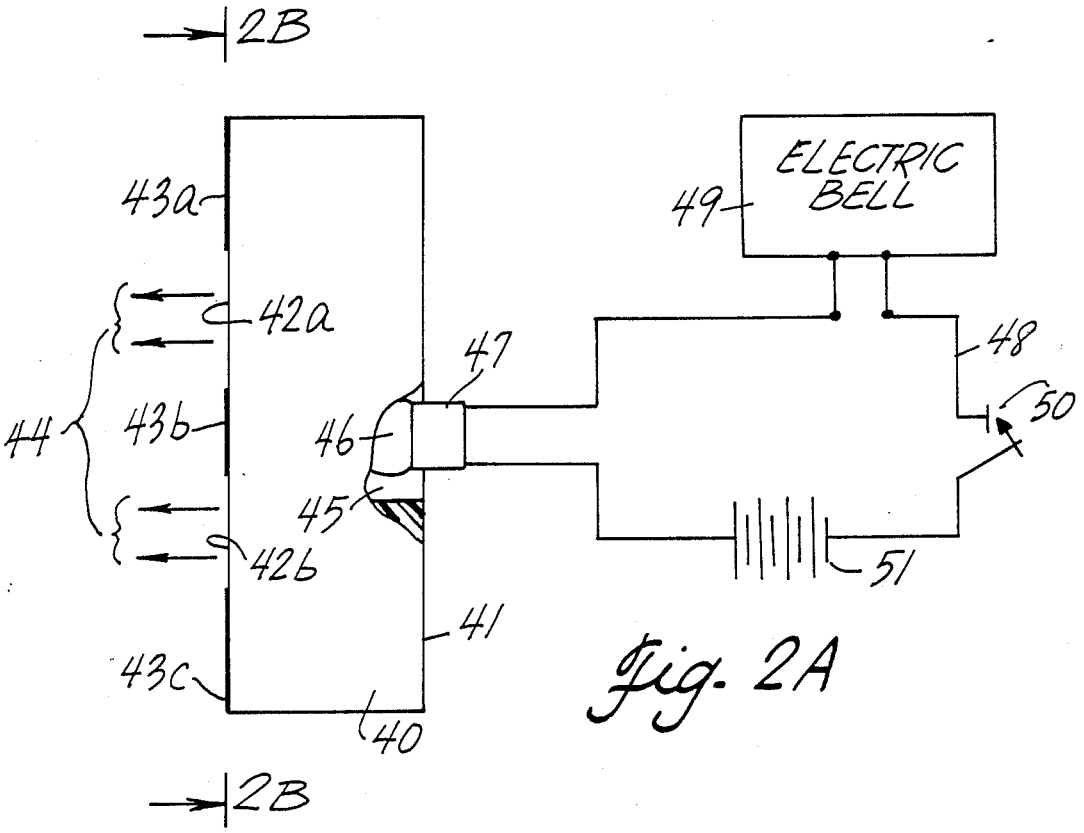
FIG. 2B illustrates a view as taken along (just in front of) the face of the sign of FIG. 2A as taken along lines 2B—2B of FIG. 2A.

FIG. 2A illustrates both diagrammatically and symbolically a more specific embodiment of the invention, directed to a combination doorbell and lighted name-sign or house-number sign, or the like. More particularly there is disclosed a fiber optic plastic 40. There is the side 41 thereof which is at the light-inlet ends of the crystalline or microscopic light-conveying channels thereof, and the opposite light-emitting side-portions 42a and 42b from which light 44 is emitted through open spaces between the different portions of the configuration-forming structures or materials 43a, 43b and 43c, as light is emitted at substantially even brilliance across a much broader cross-sectional area as contrasted to small light-exposure area at the bulb 46. The configuration-defining structure(s) 43a, 43b and 43c may optionally be opaque or translucent coated or impregnated matter or separate structure(s). The light bulb 46 is mounted in electrical socket 47 that includes circuitry wiring 48 having an electric doorbell 49 mounted in electrical series with the electrical socket 47 and typically the battery 51. On the fiber optic plastic 40, in the side 41 thereof, there is indentation space 45 having the light 46 positioned therein. Light 46 is turned-on by the closing of the switch 50.

Figure 2B:
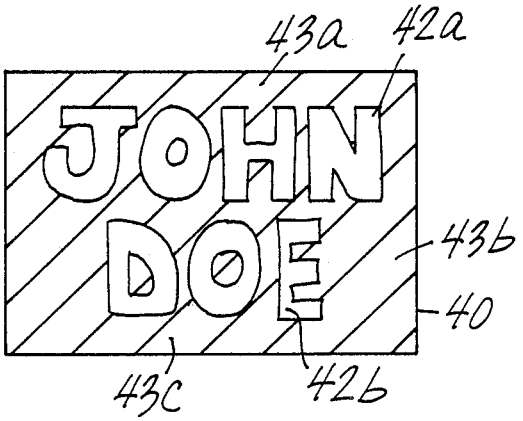

FIG. 2B illustrates the appearance of the embodiment of FIG. 2A as taken along line 2B—2B of FIG. 2A, depicting the lighted letters spelling JOHN DOE.

Figure 3B:
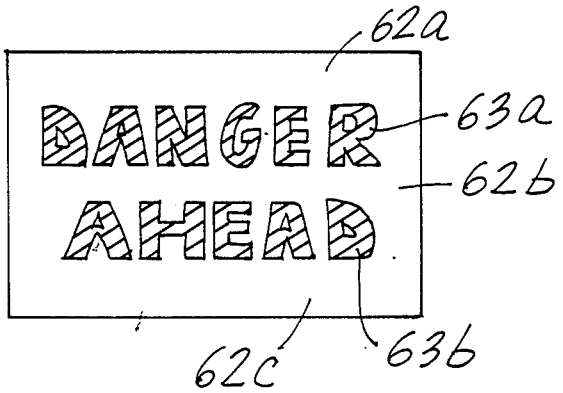
FIG. 3B illustrates a view as taken along (just in front of) the face of the sign of FIG. 3A as taken along lines 3B—3B of FIG. 3A, in top perspective view.
Figure 3A:
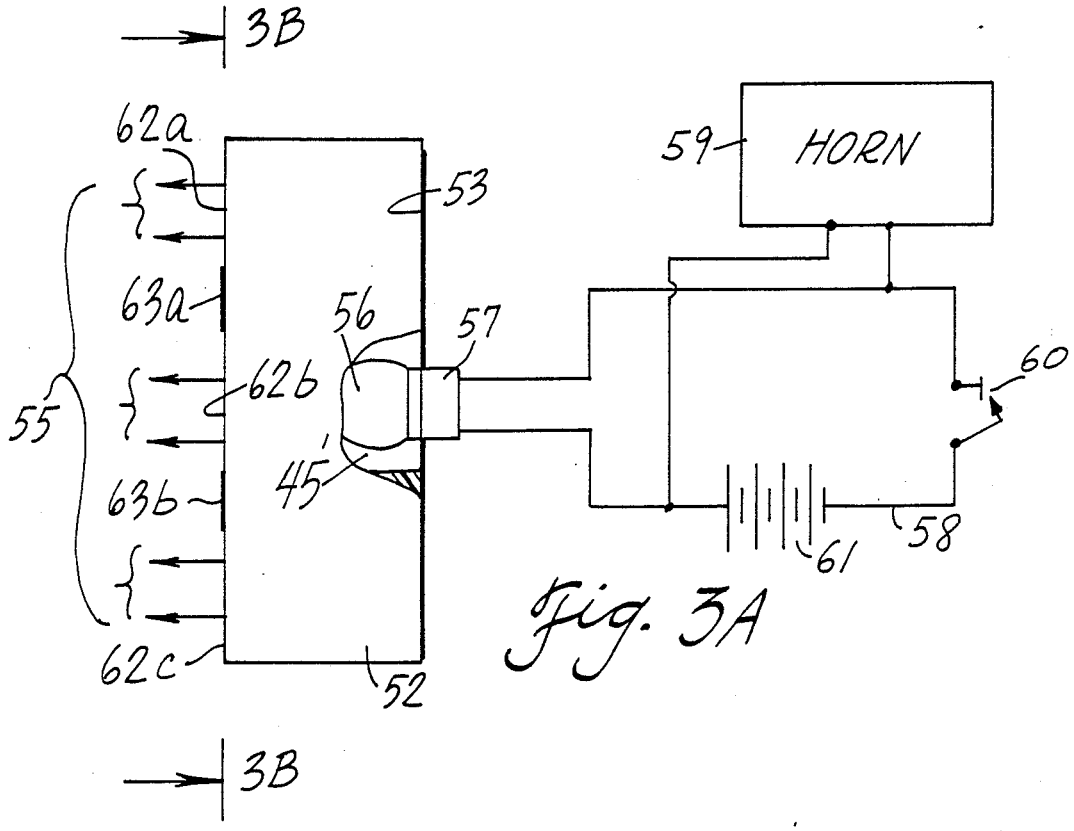
FIG. 3A illustrates diagrammatically another typical and preferred embodiment including a sign-horn combination, together with illustrating particular elements of the particular sign itself, all symbolically shown.

FIG. 3A illustrates diagrammatically and symbolically another alternate embodiment basically the same as that of FIG. 2A except that in this embodiment the letters and words are formed by the opaque configuration-forming structures 63a and 63b against the lighted-background 62c, and the circuitry is here is in parallel, although it could be electrical series, for the electric horn or other sounder, just as the circuitry in the FIG. 2A embodiment could as well alternately be in parallel instead of in electrical series. More particularly, this Figure discloses the fiber optic plastic 52 having a substance with a reflective surface 53 facing the light-inlet ends of the crystalline or microscopic channels, except for the portion having the light bulb 56 inserted into the space 45'. The light bulb 56 is inserted into the socket 57 which is in electrical parallel with the horn 59 by circuit 58 relative to the battery 61—noting that other electrical source may be employed such as a transformer with an AC electrical current source. The light from the bulb 56 emits light to a limited cross-sectional area, but the light 55 emitted brilliantly and substantially of even illumination from the outlet side (light-outlet ends of the crystalline or microscopic light-carrying channels), thereafter passes through spaces (unblocked areas) 62a, 62b and 62c (between opaque or substantially opaque or translucent materials 63a and 63b). In the electrical circuit 58, there is the normally open switch 60. FIG. 1C is typically an advertising display.

FIG. 3B illustrates a view taken along line 3B—3B of FIG. 3A, spelling out and illuminating the letters and words spelling DANGER AHEAD.

FIG. 4 illustrates an in-part view of a floor or pavement or the like, having a recessed channel having mounted therein an elongated fiber optic plastic, with one or more typically low intensity light source mounted at an end thereof or intermittently therealong—with the result of the entire strip being illuminated as a guide line and providing some degree of lighting in the vicinity, such as down the isle of a movie theater, or at a traffic cross-walk, and/or along or as a center line of a highway, and/or along a floor of a hallway. More particularly, the floor 64a and 64b has the fiber optic strip 66 shown in partial cross-section with its illuminated upper surface 65, lighted by light bulb 68 placed in space 67. The bulb 68 is mounted in socket 69 that is illustrated in circuit by circuitry 70 having switch 71 in electrical series, relative to the battery 72 (or other electrical source). Emitted light is symbolically illustrated by vertically appearing arrows.

FIG. 5 illustrates a typical other alternate embodiment in which the illuminated letters, words, disk-glass or the like, is distantly removed from the light source, here being typically a new version of a red-yellow-green stop light that alternately switches intermittenly from red to yellow to green to yellow and back to red in a convention manner by virtue of a conventional three separate light bulbs controlled by a three-way circuit and switching device of conventional and/or desired and/or presently already commercially available marketing source. As a result, the light source and switching mechanism are distantly removed from the illustrated red, yellow and green glasses that would be seen by the public, such mechanism and lights being conveniently located for easy maintenance and servicing at some accessible location, with the fiber optic cables leading from the respective lights to the illuminated red, yellow and green glasses or plastic or the like. It is noted that the fiber optic plastic itself may emit the desired red, yellow or green colors, devoid of any additional outer glass or plastic, if desired, as an alternate embodiment. Also, the outer glass or plastic may be considered to be the configuration-defining translucent colored elements, in light-traveling series with light emitted from the fiber optic plastic. More particularly, the mounting structure 73 of the stop (traffic) light has the transparent or translucent green-producing structures 74a and 74b in contact with or slightly spaced from the fiberoptic plastics 77a and 77b respectively, and likewise the transparent or translucent yellow-producing structures 75a and 75b in contact with or slightly spaced from the fiberoptic plastics 78a and 78b respectively, and likewise the transparent or transparent red-producing structures 76a and 76b in contact with or slightly spaced from the fiberoptic plastics 79a and 79b respectively. The respective fiberoptic plastics are provided light by the fiberoptic cables 80, 81, and 82 respectively. Typically and symbolically the structure 73 is supported by ring 83 suspended from a cable 84 shown-in-part. The fiber optic cables receive light from typically a plurality of light bulbs (each bulb of about 300(−) milliamps, preferably 100(−) milliamps), as above-described symbolically represented together with the switching mechanism(s), transformer, etc., by the square 87, provided by typical electrification typically represented by circuitry 88 having an outside AC electrical power-source 89, or alternatively battery (which would not require transformer). Fiber optic cables 80 through 82 are branches of composite cables 85a and 85b respectively which form the composite cable 86.

FIG. 6 illustrates still another typical embodiment, in which the light-emitting fiber optic plastic is mounted on here each and both the horizontal floor or walking-surface (in a grooved cut-out), and the upright step-structure, of a series of consecutive steps and/or landings, in order to facilitate persons seeing the steps such that in darkened areas persons going up and/or down the steps are less likely to stumble and/or fall, reducing hazards normally associated with steps. More particularly, these is shown the horizontal fiber optic strips 95a, 95b, and 95c emitting upwardly-facing light 100, and uprightly-positioned fiber optic strips 96a, 96b and 96c emitting horizontally-directed light 99. Accordingly, these lighted fiber optic plastics are provided for the landing walkway 92, the step 94b and 94a and bottom landing walk-way 93, with upright step structures 94a', 94b' and 94c'. The light-transmitting fiber optic cables is connected to the light-input ends of the fiber optic plastic strips at junction boxes 97a, 97b and 97c, with light transmitted from light source illustrated as box 8' on the floor 91. The upper landing floor is illustrated as 90. Light from light-source 8' is conveyed by light-conveying fiber optic cables 98a, 98b and 98c.

FIG. 7 illustrates another arrangement that may be utilized form one or more of the preceding embodiment, with regard to the light-emitting outlet for the employed fiber optic plastic(s) of the signs of this invention. In particular, for the fiber optic plastic strip 104, preferably with the outlet-ends of the crystalline or microscopic channels 113 blocked-off by a reflective surface(s) 102a (and 102b) facing the emitted light, so as to redirect (by reflection) the light back into the channels 113, light is emitted through either abraided or cut-away side-portions 103, and in this embodiment there is a fluorescent and/or luminescent matter and/or coating 103 placed thereon to further enhance to light emission outwardly as visibly discernible, the outer surface of the unabraided portion 101 being not readily transmittable of light. The light bulb(s) 106 is/are placed in cut-out(s) 105, mounted in electrical socket 107 of circuitry 108 having in series therewith the switch 110 relative to the battery 109 (or other equivalent electrical power), typically an advertising display. As previously broadly described, the light in one preferred embodiment may be emitted from a cut-away surface 112 in the side of unabraided portion 101 of the fiber optic plastic strip 104, such that light transmitted through fiber optic channels 113 is emitted in directions indicated by arrows 111.

Except as mentioned in the foregoing specification, there is no known existing prior art having any negating effect on the patentability of the present invention, a patentability search having been conducted by the inventor's patent attorney. While there are optical displays such as of Angst U.S. Pat. No. 4,214,391 granted Jul. 29, 1980, and light-transmitting fibers 64 and 64a and 66 of Brown U.S. Pat. No. 3,164,918 dated Jan. 12, 1965, there is not any and display sign of Ford U.S. Pat. No. 2,354,367 granted Jul. 25, 1944, such patents represent merely convention non-relevant art such as existing acknowledged fiber optic cables and prior signs—none of which teach nor suggest any of the inventive concepts or sign-combinations of the present invention, nor do they recognize the problems nor how such problems could be overcome.

It is within the scope of the present invention to make variations and substitution of equivalents to the extent that would be obvious to a person of ordinary skill in this art.

I claim:

1. A sign device comprising in combination: a substrate including a visibly-exposed substrate surface positioned to be susceptable of being lighted by the directing of light thereon, configuration means including substantially opaque matter circumscribingly arranged and selectively blocking-out light forming at-least one visibly discernible configuration of substantially circumscribed shape for being shaped by said opaque matter when light is directed onto said substrate surface, said substrate being sufficiently transparent such that light directed upon said substrate-surface and passing through said substrate is visibly discernible except to the extent that the light is blocked by said opaque matter of said circumscribed-shape, said configuration means including an optic fiber means having an outer surface comprising said opaque matter, a light source means for providing light, and said fiber optic means for directing light onto said substrate surface and onto said configuration means such that said visibly discernible configuration is produceable when light is directed from said light source means through said fiber optic means onto said substrate and said configuration means, said fiber optic means comprising fiber-optic plastic crystalline light channels and said fiber optic means further including said configuration means with said opaque matter of said outer surface of said side wall substantially encompassing the visibly-exposed substrate sufficiently to form said visibly discernible configuration, and said fiber optic means having a light-input end, and in which said light source means comprises an electric bulb positioned at said light-input end of said light channels of the fiber-optic plastic, and said fiber optic plastic means including said configuration means by having part of its outer surface removed in portions forming said visibly discernible configuration shaped by said opaque matter when light is passed from within said crystalline light channels.

2. A sign device comprising in combination: a configuration means comprising a visually-exposed substrate and opaque matter, said visually-exposed substrate having a surface, said substrate being positioned to be solely directly lightable by fiber optic light shone directly thereon directly from light-conveying fiber optic channels by the directing of fiber optic light directly thereon, said configuration means being for positioning said opaque matter to partially blocking light shone toward said surface such that at-least one of said visually-exposed substrate and said opaque matter substantially circumscribes a visually discernible configuration relative to a remaining other one of said visually-exposed substrate and said opaque matter; a light source means for providing light; and fiber optic means including a plurality of parallel light-conveying fiber-optic channels having opposite light-inlet ends and light-outlet ends thereof, for directing light from said light source means emitted from said light-outlet ends directly onto said visually-exposed substrate and said opaque matter, said substrate being positioned to directly receive light rays emitted from said light-outlet ends of said plurality of parallel fiber optic channels.

3. A sign device of claim 2, in which said configuration means includes substantially opaque matter arranged to block-out predetermined portions of light such that light directed directly onto said substrate is visibly discernible as forming said discernible configuration as shaped by circumscribing said opaque matter.

4. A sign device of claim 2, including substantially opaque matter circumscribing the configuration and said opaque matter being arranged to block-out predetermined portions of light directed onto said substrate, and in which said substrate is sufficiently transparent such that light directed on and passing through the substrate is visibly discernible except to the extent that the light is blocked by said opaque matter circumscribing the configuration.

5. A sign device of claim 4, including fluorescent matter positioned to receive illumination light directed onto a visibly discernible portion of said substrate such that said fluorescent matter fluoresces when the substrate receives light by the fiber optic means from the light source means thereby accentuating said visibly discernible configuration.

6. A sign device of claim 5, in which said fluorescent matter is in contact with said substrate.

7. A sign device of claim 1, in which said configuration means is substantially opaque, circumscribed by the substrate, the substrate being substantially transparent, circumscribing and visibly discernible and/deliniating said configuration when light is shown upon said substrate through said fiber optic means from the light source means.

8. A sign device of claim 7, in which fluorescent matter is positioned to receive illumination light directed onto a visibly discernible portion of said configuration means such that the fluorescent matter fluoresces when light is directed thereto through said fiber optic means from the light source means.

9. A sign device of claim 8, in which said fluorescent matter is in contact with said configuration means.

10. A sign device of claims 4, 5, 6, 7, 8 or 9, in which said fiber optic means comprises fiber-optic plastic having crystalline light channels formed therein, and in which said light source means comprises an electric light bulb positioned at the light-input end of said light channels of the fiber-optic plastic.

11. A sign device of any one of claims 4, 5 or 6, in which said fiber optic means comprises at-least one fiber optic cable having crystalline light channels formed therein, and in which the light source means comprises an electric light bulb positioned at said light-input end of said light channels.

12. A sign device of claim 11, including a plurality of said fiber optic cables positioned such that a light-output end thereof is adapted to illuminate said substrate when light from said light source means is channelled through said fiber optic cable.

13. A sign device of any one of claims 12 and 1, in which said light source means comprises a doorbell apparatus, circuitry thereof including transformer thereof, electric light receptacle and said light bulb, all adapted to carry voltage and amperage for a light fixture of up-to about 300 milliamps, said electric light receptacle and light bulb being connected in electrical services with said circuitry of said doorbell apparatus.

14. A sign device of claim 13, in which said doorbell apparatus, circuitry thereof and transformer, electric light receptacle and bulb, all are adapted to carry amperage of up-to about 100 milliamps.

15. A sign device of any one of claims 2, 3, 4, 5, 6, 7, 8, 9 and 1, including a stop-light sign structure, and the substrate and configuration means being adapted to form a plurality of configurations as at least separate red and green lights, and an alternating means for alternately interrupting illumination imparting the separate red and green lights.

16. A sign device of claim 15, in which said light source is spaced-away distantly from said substrate and configuration means, and in which said fiber optics means includes at-least one elongated fiber optic cable positioned to conduct light from said light source means to said substrate and said configuration means.

17. A sign device of any one of claims 2, 3, 4, 5, 6, 7, 8, 9, and 1, including a floor-structure having at least one elongated channel therein, said substrate, configuration means and said fiber optic means being positioned therein such that at-least one visibly discernible configuration is formed along an extended length of the elongated channel(s).

18. A sign device of claim 17, in which said floor-structure comprises a crosswalk for pedestrians.

19. A sign device of any one of claims 2, 3, 4, 5, 6, 7, 8, 9, and 1, including a step-structure having said substrate and configuration means and said fiber optic means mounted onto said step-structure and positioned to provide illumination for persons stepping thereabout.

20. A sign device of any one of claims 2, 3, 4, 5, 6, 7, 8, 9 and 1, including a danger-type sign structure having said substrate and configuration means and said fiber optic means mounted thereon positioned to form a configuration imparting a predetermined message of danger.

21. A sign device of any one of claims 2, 3, 4, 5, 6, 7, 8, 9 and 1, including a display advertising structure.

22. A sign device of claim 21, in which said substrate and said configuration means form a configuration portraying a visibly discernible object when illuminated by said light source means.

23. A sign device of claim 21, in which said substrate and said configuration means form a configuration portraying at least one visibly discernible letter when illuminated by said light source means.

24. A sign device of claim 21, in which said substrate and said configuration means form a configuration portraying at least one visibly discernible number when illuminated by said light source means.

* * * * *